US005535920A

United States Patent [19]

Blair, Jr. et al.

[11] Patent Number: 5,535,920

[45] Date of Patent: Jul. 16, 1996

[54] ADHESIVE CURING ABATEMENT SYSTEM

[75] Inventors: William S. Blair, Jr., Lawrenceville; Gregory J. Gabryszewski, Lithonia, both of Ga.

[73] Assignee: Nordson Corporation, Westlake, Ohio

[21] Appl. No.: 372,938

[22] Filed: Jan. 17, 1995

[51] Int. Cl.[6] ..... B67D 5/62

[52] U.S. Cl. ..... 222/1; 222/146.5; 222/152; 222/190; 34/372

[58] Field of Search ..... 222/1, 190, 146.5, 222/152; 34/219, 372, 375

[56] References Cited

U.S. PATENT DOCUMENTS

| | | | |
|---|---|---|---|
| 3,820,687 | 6/1974 | Brock | 222/152 X |
| 4,125,208 | 11/1978 | Bettermann | 222/152 |
| 4,308,447 | 12/1981 | Notzold et al. | 222/146.5 X |
| 4,666,066 | 5/1987 | Boccagno et al. | 222/146.5 |
| 4,724,983 | 2/1988 | Claassen | 222/146.5 |
| 4,811,863 | 3/1989 | Claassen | 222/146.5 |
| 4,848,420 | 7/1989 | Claassen | 141/82 |
| 4,919,308 | 4/1990 | Majkrzak | 222/146.5 |
| 5,152,433 | 10/1992 | Mohri | 222/152 |

FOREIGN PATENT DOCUMENTS

| | | | |
|---|---|---|---|
| 946324 | 4/1974 | Canada | 222/152 |
| 8600021.7 | 2/1986 | Germany . | |
| 3600020 | 7/1987 | Germany . | |

OTHER PUBLICATIONS

*200/400 Series Hot–Melt Drum Unloaders and Bulk Melters* brochure by May Coating Technologies, Inc., St. Paul, Minnesota, 1989; *Hot Melt Processors To Process Moisture–Curing Adhesives In a Moisture–Controlled Environment* brochure by May Coating Technologies, Inc., St. Paul, Minnesota; *Solventless Adhesive Processing Hot–melt Processors from Acumeter* brochure by May Coating Technologies, Inc., St. Paul, Minnesota; *May Coating Technologies, Inc.* brochure on Models 100–400B, 600–2400 B and Model 50 Bulk Melters; *1PG–One Gallon Pail Melter* brochure by May Coating Technologies, Inc., St. Paul, Minnesota; *Adhesives Age,* Jul. 1994, p. 12.

*Primary Examiner*—Andres Kashnikow
*Assistant Examiner*—Kenneth Bomberg
*Attorney, Agent, or Firm*—Wood, Herron & Evans

[57] ABSTRACT

A hot melt adhesive dispensing apparatus (10) having a hopper (16) and a lid (26) includes an adhesive curing abatement system (12) comprising a plurality of gas jets (40) mounted proximate to the side wall (42) of the hopper (16). The gas jets (40) inject one of either an inert gas or dry air downwardly and inwardly into the hopper (16), thereby reducing the contact of moisture laden ambient air with moisture cure adhesive contained therein. The adhesive curing abatement system (12) may also include an exhaust system (50) to vacuum vapors generated by the moisture cure adhesive and the inert gas or dry air from the hopper (16) when the lid (26) is open and to bleed off any injected inert gas or dry air as well as vapors generated by the moisture cure adhesive when the lid (26) is closed.

21 Claims, 2 Drawing Sheets

ADHESIVE CURING ABATEMENT SYSTEM

FIELD OF THE INVENTION

The present invention relates to methods and devices for reducing the premature curing of moisture cure adhesives in hot melt adhesive dispenser units.

BACKGROUND OF THE INVENTION

Hot melt adhesives, or adhesives that are solid at room temperature and which must be melted prior to use, are used in an increasing number of applications. For example, hot melt adhesives may be used for coating substrates, for sealing of packages, for building construction, shoe manufacturing, bookbinding, for the assembly of automobile parts, electronics, electrical equipment, appliances, electrical components, furniture, and for metal-to-metal bonds, to name but a few. Because the hot melt adhesives are solid at room temperature, it is necessary to melt the adhesive prior to application.

A common type of hot melt adhesive is the type known as a moisture cure adhesive. As the name implies, moisture cure adhesives cure in the presence of water molecules in the ambient air. This aspect of moisture cure adhesives poses a problem for systems that melt and dispense the material. Typically, systems for melting and dispensing moisture cured hot melt adhesives include a lidded hopper for holding the solid hot melt adhesive and means for melting the adhesive, such as a heated grid at the bottom of the hopper. During use, the system is sealed from the ambient air to prevent premature curing of the adhesive. However, when adhesive is added to the system, ambient air having sufficient moisture to cure the hot melt adhesive may also enter the system. To reduce the premature curing of the moisture cure adhesive, dry air or an inert gas may be injected into the hopper of the hot melt adhesive system to prevent any moisture laden ambient air from contacting the adhesive.

With existing devices, the inert gas or dry air is typically injected into the hopper by a single jet in a horizontal plane and perpendicular to the wall of the hopper. Although this system may aid in preventing ambient air from being forced down onto the molten hot melt adhesive already within the hopper, it may also serve to trap moisture laden ambient air between the surface of the molten hot melt adhesive and the plane of the injected gas. Thus, existing systems may exacerbate the problem of premature curing. Moreover, existing systems also may suffer from additional drawbacks.

First, polyurethane reactive adhesives or PUR, a common type of moisture-cured adhesive, typically uses methylene bisphenal diisocyanate (MDI) as a curative. The vapors generated by the hot melt will contain particles of this curative. OSHA dictates that the MDI levels in the operator's environment not exceed 5 parts per billion. Thus, many adhesive manufacturer's recommend that adequate ventilation be provided. However, existing systems for melting and dispensing moisture-cured hot melt adhesives often rely on exhaust systems external to the hot melt dispensing device rather than integral therewith. In these types of devices, after adhesive is added to the hopper, the lid of the hot melt adhesive apparatus is closed. As inert gas or dry air is injected into the hopper, the injected gas creates a positive pressure therein. Because of the positive pressure, the inert gas or dry air, as well as vapors from the hot melt adhesive, may be forced through internal leak paths, such as at joints and fittings, and out into the operator's environment, thereby evading the external exhaust system.

Alternatively, existing systems that do include an integral exhaust system within the hot melt dispensing device suffer from the contrary problem. When the lid of the hopper is in an open position, the exhaust system is free to draw not only the vapors from the hopper, but also ambient air from outside of the system. However, when the lid is closed, the exhaust system continues to draw gas from the hopper, creating a negative pressure within the hopper because the airflow of the exhaust system typically exceeds that of the airflow of the inert gas or dry air into the hopper. This negative pressure may cause moisture laden ambient air to enter from the environment into the hopper through any leak paths in the unit. This entry of moisture laden ambient air may cause premature curing of the adhesive within the hot melt dispensing device.

Therefore, there is a need for an adhesive curing abatement system that is effective in reducing the premature curing of hot melt adhesive within a hot melt dispensing device without the foregoing disadvantages of existing systems. Further, there is a need for a moisture cure abatement system that includes an integral exhaust system which eliminates the positive pressure within the hopper of the hot melt dispensing device without drawing moisture laden ambient air into the hot melt adhesive system.

SUMMARY OF THE INVENTION

The present invention provides an adhesive curing abatement system which overcomes drawbacks associated with current systems. More specifically, the adhesive curing abatement system of the present invention reduces the premature curing of moisture cure adhesive within a hot melt dispensing apparatus. To this end, and according to one embodiment of the present invention, a hot melt adhesive dispensing apparatus having a hopper with an open upper end, a lower end, and a side wall, and a melting unit is provided with an adhesive curing abatement system having a plurality of gas jets, positioned proximate the side wall of the hopper of the hot melt adhesive dispensing apparatus. The plurality of gas jets are oriented downwardly and inwardly relative to the side wall and inject one of either an inert gas or dry air downwardly and inwardly into the hopper. By injecting gas downwardly and inwardly into the hopper, the inert gas or dry air creates a rotational flow of gas within the hopper that sweeps the surface of any moisture cure adhesive within the hopper and removes any moisture laden ambient air therefrom. Further, as the rotating gas moves upwardly in the hopper any solid hot melt adhesive within the hopper will be bathed in the inert gas or dry air.

The hopper and side wall are preferably cylindrical. Moreover, there are preferably six gas jets, which are spaced substantially equally along a circumference of the cylindrical side wall. The gas jets are oriented downwardly at an angle from about 20 degrees to about 65 degrees relative to horizontal, and oriented inwardly at an angle of about 30 degrees relative to the cylindrical wall. Preferably, the gas jets are oriented downwardly at an angle of from about 30 degrees to about 45 degrees relative to horizontal. The gas jets are adapted to inject either inert gas or dry air at a combined rate of from about five standard cubic feet per minute to about seven standard cubic feet per minute.

In addition, the adhesive curing abatement system includes an exhaust system that is in fluid communication with the hopper through a vent hole formed in the side wall of the hopper. This exhaust system is adapted to withdraw gas through the vent hole when the lid of the hot melt adhesive apparatus is in an open position, and to draw air from an ambient source when the lid is in a closed position. At the same time, when the lid is in a closed position, the exhaust system is adapted to bleed off the inert gas or dry air being injected into the hopper and also any vapors generated by the moisture cure adhesive that is in the hopper.

The exhaust system includes a venting network having an exhaust path interconnected at a common junction to a vent path in communication with the vent hole, and an ambient source path in communication with an ambient source of air. Located within the common junction is a flow diverter valve that is operatively interconnected to the lid such that when the lid is in the open position, the flow diverter valve is in a first position so that the exhaust path is in communication with the vent path. Alternatively, when the lid is in the closed position, the flow diverter valve is placed in a second position wherein the exhaust path is in communication with the ambient source path. To enable the exhaust system to bleed off the inert gas or dry air being injected into the hopper as well as the vapors generated by the moisture cure adhesive, the valve plate of the flow diverter valve includes a bleed hole formed therein.

In use, moisture cure adhesive is placed into the hopper of the hot melt dispensing apparatus and the melting process is started. Inert gas or dry air is injected downwardly and inwardly into the hopper through the gas jets, to substantially prevent moist ambient air from contacting the moisture cure adhesive in the hopper, thereby reducing premature curing of the moisture cure adhesive. Moreover, the downward and inward injection of inert gas or dry air into the hopper generates a rotational flow of gas within the hopper which sweeps the lower end of the hopper and prevents the accumulation of ambient air on the moisture cure adhesive in the hopper. The rotational flow also causes the gas in the hopper to rise, thereby bathing any solid moisture cure adhesive in the hopper with the injected inert gas or dry air.

When the lid of the hot melt adhesive dispensing apparatus is in the open position, the exhaust system of the apparatus vacuums gas from the hopper through the venthole in the side wall. Alternatively, when the lid of the hot melt adhesive apparatus is in the closed position, the exhaust system vacuums air from an ambient source, while simultaneously bleeding off the inert gas or dry air being injected into the hopper as well as any vapors generated by the moisture cure adhesive in the hopper.

Of course, any suitable gas injecting devices, such as the gas jets described above, could be used. By virtue of the foregoing, there is thus provided an adhesive curing abatement system that reduces the premature curing of moisture cure adhesive within the hopper of a hot melt adhesive dispensing apparatus. Additionally, the adhesive cure abatement system includes an exhaust system adapted to vacuum gas from the hopper when the lid of the apparatus is in an open position, and to bleed off any injected inert gas or dry air as well as vapors generated by the moisture cure adhesive when the lid is in a closed position.

These and other objects and advantages of the present invention shall become apparent from the accompanying drawings and the detailed description thereof.

BRIEF DESCRIPTION OF THE DRAWINGS

The accompanying drawings, which are incorporated in and constitute a part of this specification, illustrate an embodiment of the invention and, together with a general description of the invention given above and the detailed description given below, serve to explain the principles of the present invention.

DETAILED DESCRIPTION OF THE INVENTION

Figure 1:
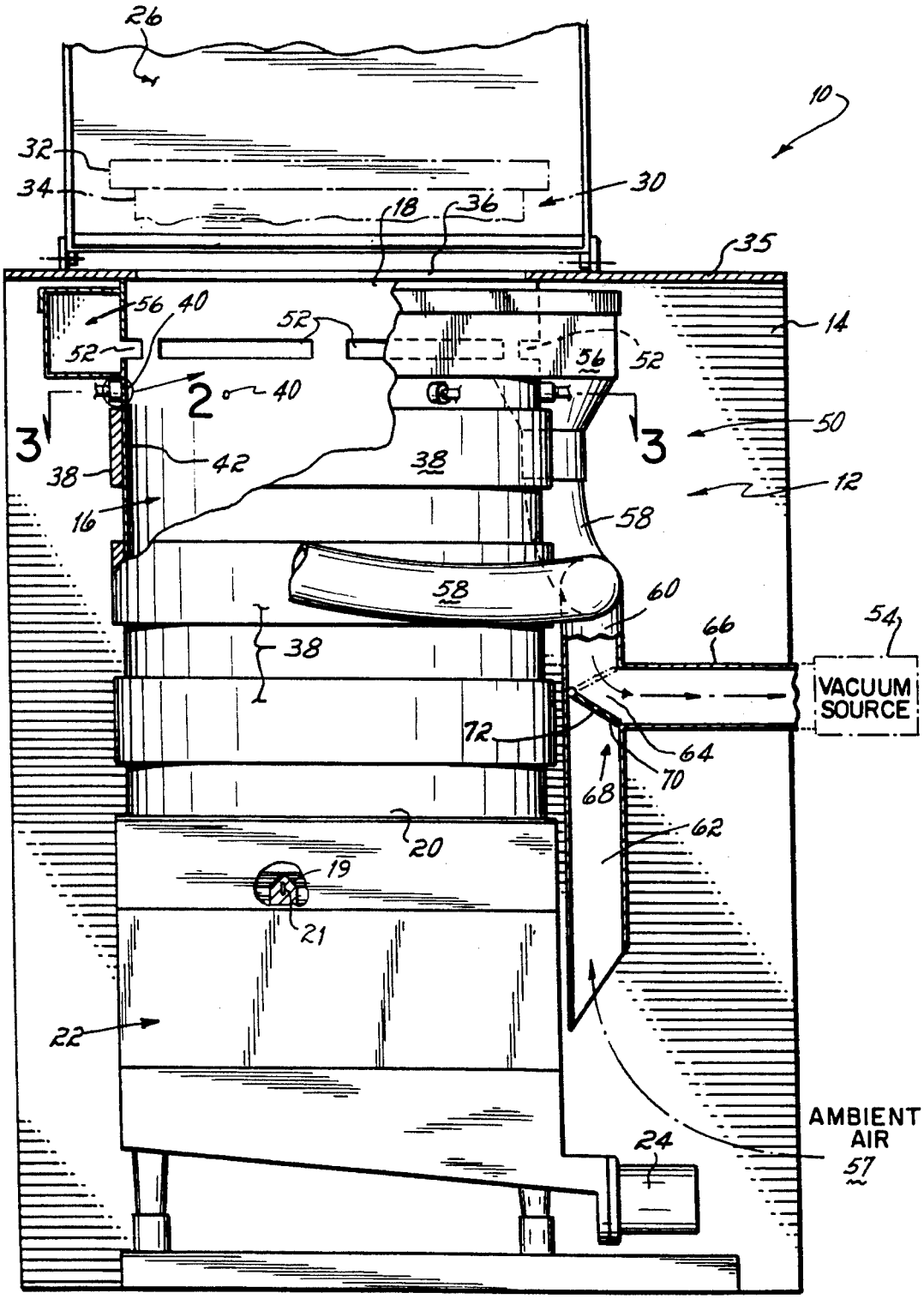
FIG. 1 is a front elevational view, partially broken away, of a hot melt adhesive dispensing apparatus including an adhesive cure abatement system in accordance with the principles of the present invention.
Figure 2:
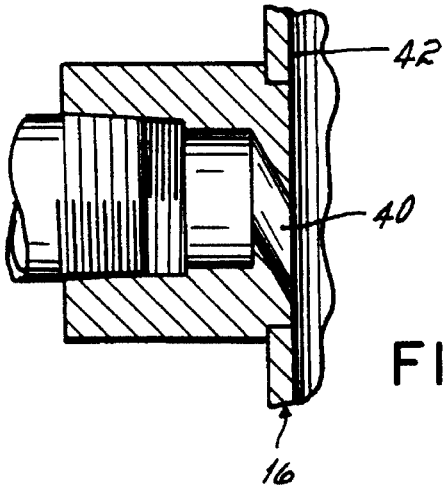
FIG. 2 is a greatly enlarged view of the encircled portion 2 of FIG. 1.
Figure 3:
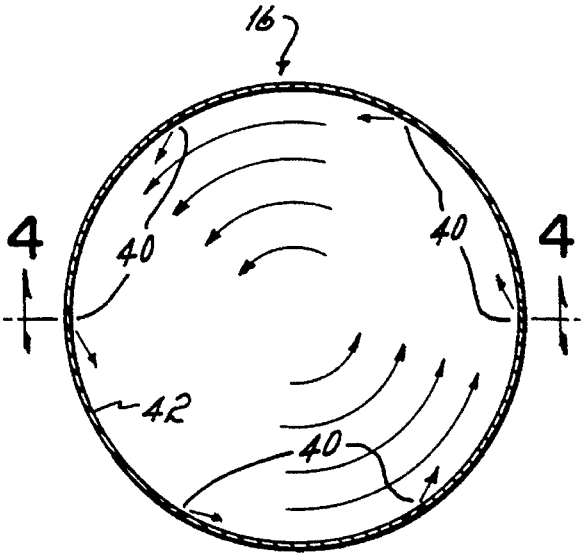
FIG. 3 is an illustrative view of injected inert gas or dry air flow taken along line 3—3 of FIG. 1.

FIGS. 1–2 illustrate a hot melt adhesive dispensing apparatus 10 having an adhesive curing abatement system 12 adapted to reduce the premature curing of moisture cure adhesive held therein. To this end, and in accordance with the principles of the present invention, hot melt adhesive dispensing apparatus 10 comprises a housing 14, a hopper 16 supported therein having an open upper end 18 and a lower end 20, a melting unit or grid 19 with a heating element 21 therein disposed beneath lower end 20 of hopper 16, and a reservoir 22 positioned beneath melting unit or grid 19, the reservoir being in fluid communication with a pump and manifold assembly 24.

Hopper 16, which is preferably cylindrical but which may be any shape, is adapted to receive solid hot melt adhesive, such as moisture cure adhesive, either as granules, pellets, or other smaller units, or in bulk form, such as in a container 30, as shown. Container 30 has an open lower end (not shown) to permit the release of the hot melt adhesive contained therein. Preferably, hopper 16 is sized to receive a 55 gallon container of adhesive, as is common. However, as will be readily appreciated, hopper 16 may be sized to accommodate containers of different sizes, such as 1 gallon or 5 gallon containers, or various quantities of granules or pellets of hot melt adhesive. Moreover, housing 14 includes a top 35 having an aperture 36 formed therein that is sized to receive container 30 therethrough.

Container 30 may be suspended within hopper 16 by any number of well known means. For example, a clamp ring 32 may be placed around the upper end 34 of container 30 for supporting container 30 on housing 14. Alternatively, container 30 could be supported by melting grid 19, or by any inwardly projecting structure within hopper 16, such as a ledge or ting. These and other variations will be readily apparent to those skilled in the art.

As the hot melt adhesive in container 30 is solid when placed within hot melt adhesive dispensing apparatus 10, the hot melt adhesive must be molten prior to use. Where the hot melt adhesive is a one-piece solid within container 30, the adhesive must first be withdrawn therefrom. To this end, band heaters 38 surround hopper 16, which, when activated, serve to heat the hot melt adhesive within container 30 such that the hot melt flows out of, or is released as a solid unit from, container 30. As will be readily appreciated by those skilled in the art, other types of heaters may be used to remove the adhesive from container 30, such as, by way of example, cylindrical heaters or cartridge heaters.

The hot melt adhesive that is released from container 30, or hot melt adhesive placed in hopper 16 in granule or pellet form, is then passed through melting grid 19. The melting grid is effective to partially melt the body of hot melt adhesive and pass it downwardly into reservoir 22. Reservoir 22, which also includes heater units (not shown), serves to fully melt the hot melt adhesive for delivery by the pump and manifold assembly 24 to an applicator system (not shown). To close off hopper 16 from the environment during use, a lid 26 is attached to housing 14 such that the lid is selectively positionable between a first open position and second closed position.

Where the hot melt adhesive is a moisture cure adhesive, such as polyurethane reactive adhesive (PUR), it is preferable to minimize the exposure of the adhesive to ambient air. This is necessary because the moisture cure adhesive will cure in the presence of the moisture contained in ambient air. To reduce the premature curing of the moisture cure adhesive, adhesive curing abatement system 12 injects one of either an inert gas or dry air into hopper 16 to reduce the exposure of the moisture cure adhesive to ambient air. To this end, and as best seen in FIGS. 1–4, adhesive curing abatement system 12 includes a gas injecting device, such as a plurality of gas jets 40 projecting inwardly through the cylindrical side wall 42 of hopper 16 as shown. Gas jets 40 are preferably interconnected to a single feeder line (not shown) to inject one of either an inert gas, such as nitrogen, or dry air. Although the exemplary embodiment describes the gas injecting device as a plurality of gas jets, it will be readily appreciated that other devices for injecting the inert gas or dry air into hopper 16 may be used without departing from the spirit or scope of the present invention.

Gas jets 40 are positioned proximate side wall 42, such as extending therethrough as shown, below open upper end 18 of hopper 16, are spaced substantially equally along a circumference of cylindrical side wall 42, and are oriented to inject one of either an inert gas or dry air downwardly and inwardly into hopper 16. Gas jets 40 are positioned near open upper end 18, i.e., in the upper half of hopper 16, to reduce the likelihood of adhesive within hopper 16 contacting and possibly clogging gas jets 40. However, as will be readily appreciated by those skilled in the art, gas jets 40 can be located anywhere along cylindrical side wall 42.

The downward and inward injection of the inert gas or dry air serves to create a rotational flow of gas within hopper 16 that sweeps the lower end 20 of hopper 16, thereby preventing the accumulation of ambient air along the surface of moisture cure adhesive contained therein. Similarly, the rotational flow of gas also causes the gas within hopper 16 to rise. Thus, any solid adhesive within hopper 16, the top of which may extend above gas jets 40, will nevertheless be bathed by the rotating and rising inert gas or dry air being injected into hopper 16. More particularly, it has been found that orienting gas jets at a downward angle of from about 20 degrees to about 65 degrees, and more preferably from about 30 degrees to about 45 degrees, relative to the horizontal and inwardly about 30° relative to cylindrical side wall 42 of hopper 16 provides the necessary flow of the inert gas or dry air.

Figure 4:
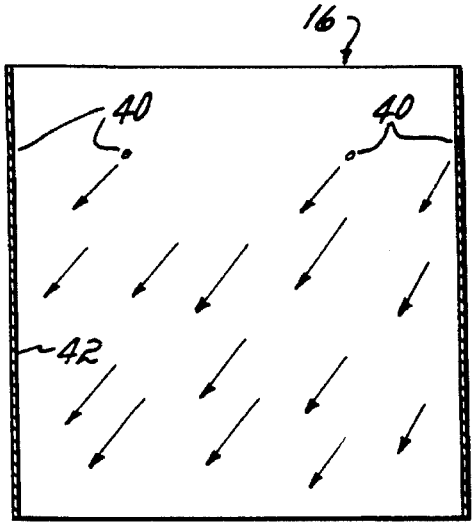
FIG. 4 is an illustrative view of injected inert gas or dry air flow taken along line 4—4 of FIG. 3.

In addition, it has been found that six gas jets spaced substantially equally along the cylindrical side wall 42 of hopper 16 provides a suitable mass flow within hopper 16. For example, as schematically demonstrated by FIGS. 3 and 4, the spacing of gas jets 40 creates a counter-clockwise rotation of gas within hopper 16 as viewed from above (FIG. 3) and at a downward angle relative to the horizontal (FIG. 4). This mass flow rotation performs a sweeping function across the surface of any moisture cure adhesive within hopper 16, thereby preventing any accumulation of moisture laden ambient air thereover. Moreover, the inert gas or dry air injected downwardly into hopper 16 will also cause gas within hopper 16 to rise as it is displaced by the injected gas. Still further, it has been found that an inlet flow of inert gas or dry air of approximately 5 standard cubic feet per minute to about 7 standard cubic feet per minute provides the necessary flow within hopper 16 to prevent ambient air from coming into contact with adhesive within hopper 16.

In addition to the gas jets 40, it has been found beneficial to include an exhaust system 50 as part of adhesive curing abatement system 12. In particular, when moisture cure adhesives, such as PUR, are molten, they produce vapors which rise within hopper 16 and which may escape into the operator's environment when lid 26 is in the open position. To prevent these vapors from entering the environment of the operator, exhaust system 50 captures the vapors before they escape into the environment. Moreover, exhaust system 50 is adapted to vent the inert gas or dry air being injected into hopper 16 when lid 26 is in a closed position.

To this end, exhaust system 50 includes at least one vent hole 52, and preferably a plurality of vent holes 52, formed in the cylindrical side wall 42 of hopper 16 and near open upper end 18, such as, by way of example, within 6 inches thereof. Vent holes 52 are operatively interconnected to a vacuum source 54 by a venting plenum 56, which surrounds hopper 16 in the area adjacent vent holes 52. Vacuum source 54 and venting plenum 56 cooperate to withdraw gas through each of vent holes 52. Preferably, the vent holes 52 are spaced substantially equally about a circumference of cylindrical hopper 16. Moreover, gas jets 40 are preferably positioned slightly below vent holes 52. This permits vent holes 52 to capture ambient air before it contacts the adhesive while not interfering with the functioning of gas jets 40.

Vent holes 52 open into venting plenum 56, which is a substantially rectangular duct surrounding hopper 16 in the region adjacent vent holes 52. Further, although venting plenum 56 is described as a rectangular box-like structure, it will be readily appreciated that other structures may be used, such as a cylindrical or otherwise shaped plenum, so long as venting plenum 56 is communication with all of vent holes 52.

To render vent holes 52 effective in withdrawing vapors and the injected inert gas or dry air from hopper 16, venting plenum 56 is interconnected to vacuum source 54. Vacuum source 54 is preferably connected to venting plenum 56 at a plurality of locations spaced substantially equally about cylindrical side wall 42. The plurality of exit points for the gas from venting plenum 56 provides a more uniform volume of gas being withdrawn through each of vent holes 52 than would otherwise occur if only one exit path for the vacuumed gas was located in venting plenum 56.

Although exhaust system 50 is effective to withdraw vapors and the injected inert gas or dry air from hopper 16 when lid 26 is in an open position, when lid 26 is in a closed position, there is no need to withdraw this volume of gas from hopper 16. In fact, attempting to draw a large volume of gas out of hopper 16 when lid 26 is closed results in hopper 16 being subject to a large negative pressure. This may cause leakage of moisture laden ambient air into the system through any internal leak paths, such as joints or fitting, which may lead to premature curing of adhesive within hopper 16.

To prevent vacuum source 54 from subjecting hopper 16 to a negative pressure, with the accompanying leakage of ambient air into the system, vacuum source 54 is adapted to draw air from an ambient source 57 when lid 26 is in a closed position. To this end, venting plenum 56 is connected by tubing 58 to a common vent path 60. In turn, vent path 60 joins with an ambient source path 62 at a common junction 64. Common junction 64 then connects to an exhaust path 66 which exits out of hot melt adhesive apparatus 10. Thus, exhaust path 66 may withdraw vapors generated by the moisture cure adhesive and the injected inert gas or dry air from hopper 16 through vent path 60, or exhaust path 66 may draw ambient air from ambient source path 62.

To enable exhaust path 66 to withdraw vapors from vent path 60 when lid 26 is in an open position, and to draw ambient air from ambient source path 62 when lid 26 is in a closed position, common junction includes a flow diverter valve 68 therein. Flow diverter valve 68 is operatively interconnected to lid 26 by means not shown such that, when lid 26 is in an open position, the valve plate 70 of flow diverter valve 68 is in the position shown in solid line in FIG. 1. In this position, exhaust path 66 is in communication with vent path 60 such that vacuum source 54 withdraws vapors and the injected inert gas or dry air from hopper 16 through vent holes 52 and venting plenum 56. Alternatively, when lid 26 is in a closed position, valve plate 70 of flow diverter valve 68 is placed in the second position shown in phantom line in FIG. 1, wherein exhaust path 66 is in communication with ambient source path 62. Thus, exhaust system 50 is effective in withdrawing vapors generated by the moisture cure adhesive and the injected inert gas or dry air when lid 26 is in an open position, and to draw air through ambient source path 62 when lid 26 is in a closed position.

As ambient air is continually drawn through ambient source path 62 when lid 26 is in a closed position, ambient source path 62 may be constructed to draw air across equipment requiring cooling during operation of hot melt adhesive dispensing apparatus 10. For example, ambient source path 62 may be adapted to draw air across pump and manifold assembly 24. Thus, adhesive curing abatement system 12 in accordance with the principles of the present invention may serve a dual function, thereby eliminating the need for separate cooling equipment for pump and manifold assembly 24.

Figure 5:
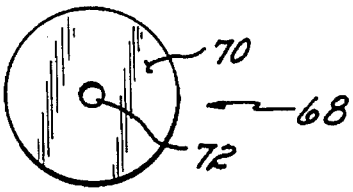
FIG. 5 is a front view of the valve plate of the flow diverter valve.

Although when lid 26 is in a closed position, vapors and injected inert gas or dry air are generally unable to pass out of hopper 16 and into the environment of the operator, as hopper 16 is heated in use, the vapors generated by the moisture cure adhesive and the injected inert gas or dry air may cause a build-up of pressure within hopper 16. This build-up of pressure may force the vapors and injected inert gas or dry air within hopper 16 out of leakage points that may exist in the system and into the environment of the operator. To vent the pressure from within hopper 16 when lid 26 is in a closed position, and thereby eliminate the leakage of vapors and the inert gas or dry air into the environment of the operator, valve plate 70 of flow diverter valve 68 is preferably manufactured with a bleed hole 72, or other means for venting the internal pressure, formed therein (FIG. 5). Thus, when valve plate 70 is in the second position shown by phantom line in FIG. 1, the positive pressure within hopper 16 is bled outwardly through bleed hole 72 and into exhaust path 66 for elimination outside the environment of the operator.

Moreover, although flow diverter valve 68 is shown as a single valve being toggled between two positions, as will be readily apparent to those skilled in the art, the single flow diverter valve of the present invention could be replaced by two damper valves acting opposite and in tandem to selectively place exhaust path 66 into communication with vent path 60 and ambient source path 62.

In use, moisture cure adhesive, such as PUR, is placed within hopper 16 of hot melt adhesive dispensing apparatus 10 and the apparatus is activated to melt the moisture cure hot melt adhesive. When hot melt adhesive dispensing apparatus 10 is activated, gas jets 40 are also activated, forcing an inert gas or dry air over the surface of any adhesive within hopper 16 that is beneath gas jets 40, generating a rotational flow of gas within hopper 16, and bathing any adhesive extending above gas jets 40 in the rising gas, thereby preventing moist ambient air from contacting the moisture cure adhesive in hopper 16.

Generally, when hot melt adhesive dispensing apparatus 10 is first activated, lid 26 will be in a closed position. Thus, flow diverter valve 68 will be in the second position and vacuum source 54 will be drawing air from ambient source path 62. When moisture cure adhesive is to be added to hopper 16, lid 26 is put into an open position. At this point, valve plate 70 of flow diverter valve 68 is placed in the first position (shown in solid line in FIG. 1), wherein exhaust path 66 is placed into communication with vent path 60. Vacuum source 54 is then effective to withdraw gas, including the injected inert gas or dry air, through vent holes 52, into venting plenum 56 and into vent path 60 for exhaust through exhaust path 66. After inserting new material into hopper 16, lid 26 is then placed into a closed position. At this point, valve plate 70 of flow diverter valve 68 is placed into the second position (shown in phantom line in FIG. 1) wherein exhaust path 66 is placed into communication with ambient source path 62. When lid 26 is closed, gas jets 40 continue to inject inert gas or dry air into hopper 16. Moreover, as hot melt adhesive apparatus 10 continues heating the moisture cure adhesive within hopper 16 and reservoir 22 when lid 26 is closed, the hot melt adhesive continues to give off vapors. Bleed hole 72 in valve plate 70 permits the vapors and inert gas or dry air in hopper 16 to be exhausted from hopper 16 through vent holes 52, venting plenum 56, and vent path 60, and into exhaust path 66.

By virtue of the foregoing, there is thus provided an adhesive curing abatement system 12 that reduces the premature curing of moisture cure adhesive within the hopper 16 of a hot melt adhesive dispensing apparatus 10 by injecting either an inert gas or dry air downwardly and inwardly into hopper 16. Additionally, adhesive curing abatement system 12 includes an exhaust system 50 adapted to vacuum vapors generated by the moisture cure adhesive and the inert gas or dry air from hopper 16 when the lid 26 of the hot melt adhesive apparatus 10 is open and to bleed off the vapors and inert gas or dry air when lid 26 is closed.

While the present invention has been illustrated by description of one embodiment that has been described in considerable detail, it is not the intention of the applicant to restrict or in any way limit the scope of the appended claims to such detail. Additional advantages will readily appear to those skilled in the art. Thus, the invention in its broadest aspects is not limited to the specific details described and departures may be made from the details without departing from the spirit or scope of the claims.

What is claimed is:

1. An adhesive curing abatement system comprising:

a hot melt adhesive dispensing apparatus including a hopper having an open upper end, a lower end, and a side wall; and a plurality of gas jets mounted proximate to said side wall of said hopper, below said open upper end, and oriented downwardly and inwardly relative to said side wall, said gas jets injecting one of either an inert gas or dry air downwardly and inwardly into said hopper to substantially prevent moist ambient air from contacting moisture cure adhesive in said hopper, thereby reducing premature curing of the moisture cure adhesive.

2. The adhesive curing abatement system of claim 1 wherein said hopper and said side wall are cylindrical, said plurality of gas jets being spaced substantially equally along a circumference of said cylindrical side wall.

3. The adhesive curing abatement system of claim 2 wherein there are 6 of said gas jets.

4. The adhesive curing abatement system of claim 2 wherein each of said gas jets is oriented downwardly at an angle from about 20 degrees to about 65 degrees relative to horizontal and inwardly at an angle of about 30 degrees relative to said cylindrical side wall.

5. The adhesive curing abatement system of claim 4 wherein each of said gas jets is oriented downwardly at an angle of from about 30 degrees to about 45 degrees relative to horizontal.

6. The adhesive curing abatement system of claim 1 wherein said plurality of gas jets injects said one of either inert gas or dry air at a combined rate of from about 5 standard cubic feet per minute to about 7 standard cubic feet per minute.

7. The adhesive curing abatement system of claim 1 further comprising a vacuum source in fluid communication with said hopper through a vent hole formed in said side wall.

8. The adhesive curing abatement system of claim 7 further comprising a lid over said hopper, said lid being selectively movable between an open position and a closed position, said vacuum source adapted to withdraw gas through said vent hole when said lid is in said open position and to draw air from an ambient source while simultaneously bleeding off said one of either inert gas or dry air injected into said hopper and vapors generated by moisture cure adhesive in said hopper when said lid is in said closed position.

9. The adhesive curing abatement system of claim 8 further comprising an exhaust system including:

an exhaust path interconnected at a common junction to a vent path in communication with said vent hole and an ambient source path in communication with an ambient source of air; and a flow diverter valve located in said common junction being operatively interconnected to said lid, said flow diverter valve being selectively positionable between a first position when said lid is in said open position, wherein said exhaust path is in communication with said vent path, such that said vacuum source withdraws gas through said vent hole and a second position when said lid is in said closed position, wherein said exhaust path is in communication with said ambient source path such that said vacuum draws air from an ambient source.

10. The adhesive curing abatement system of claim 9 further comprising means for bleeding off said one of either inert gas or dry air injected into said hopper and vapors generated by moisture cure adhesive in said hopper when said valve is in said second position.

11. The adhesive curing abatement system of claim 10 wherein said bleeding means includes a bleed hole formed in said flow diverter valve.

12. An adhesive curing abatement system comprising:

a hot melt adhesive dispensing apparatus including a hopper having an open upper end, a lower end, and a side wall, and a melting unit to melt moisture cure adhesive in said hopper; and a gas injecting device mounted proximate to said side wall of said hopper to inject one of either an inert gas or dry air into said hopper such that a rotational flow of gas is generated in said hopper, said rotational flow of gas sweeping said lower end of said hopper thereby preventing the accumulation of ambient air on moisture cure adhesive in said hopper.

13. The adhesive curing abatement system of claim 12 wherein said gas injecting device injects said one of either an inert gas or dry air downwardly into said hopper such that moisture laden air is not trapped between hot melt adhesive in said hopper and said gas injecting device.

14. An adhesive curing abatement system comprising:

a hot melt adhesive dispensing apparatus including a hopper having an open upper end, a lower end, and a side wall, and a melting unit to melt moisture cure adhesive in said hopper; and a gas injecting device mounted proximate to said side wall of said hopper to inject one of either an inert gas or dry air downwardly and inwardly relative to said side wall such that a rotational flow of gas is generated in said hopper, said rotational flow causing gas within said hopper to rise, thereby bathing any solid moisture cure adhesive with said one of either an inert gas or dry air.

15. An adhesive curing abatement system comprising:

a hot melt adhesive apparatus including a cylindrical hopper, said hopper having an open upper end, a lower end, and a cylindrical side wall, and a melting unit to melt moisture cure adhesive in said hopper;

a plurality of gas jets mounted proximate to, and spaced substantially equally along, a circumference of said cylindrical side wall of said hopper and near said open upper end, said gas jets being oriented downwardly at an angle of from about 20 degrees to about 65 degrees relative to horizontal and inwardly at an angle of about 30 degrees relative to said cylindrical wall, said gas jets injecting one of either an inert gas or dry air downwardly and inwardly into said hopper to substantially prevent moist ambient air from contacting moisture cure adhesive in said hopper; and a vacuum source in fluid communication with said hopper through a vent hole formed in said cylindrical side wall and located between said gas jets and said open upper end, said vacuum source adapted to withdraw from said hopper said one of either an inert gas or dry air injected into said hopper and vapors generated by moisture cure adhesive in said hopper.

16. A method of reducing premature curing of moisture cure adhesives in a hot melt adhesive dispensing apparatus including a hopper having an open upper end, a lower end, and a side wall, comprising:

inserting into said hopper moisture cure adhesive to be melted;

melting said moisture cure adhesive; and injecting into said hopper one of either an inert gas or dry air downwardly and inwardly to substantially prevent moist ambient air from contacting said moisture cure adhesive, thereby reducing premature curing of said moisture cure adhesive.

17. The method of reducing premature curing of claim 16 further comprising:

generating a rotating flow of gas within said hopper; and sweeping said lower end of said hopper with said rotating flow of gas to prevent the accumulation of ambient air on said moisture cure adhesive in said hopper.

18. The method of reducing premature curing of claim 16 further comprising:

generating a rotating flow of gas within said hopper, said rotating flow causing said gas to rise in said hopper; and bathing said moisture cure adhesive with said one of either an inert gas or dry air.

19. The method of reducing premature curing of claim 16 further comprising venting gas from said hopper through a vacuum source in fluid communication with said hopper through a vent hole formed in said cylindrical wail.

20. The method of reducing premature curing of claim 19, said hot melt adhesive dispensing apparatus further including a lid over said open upper end of said hopper, said lid being selectively positionable between an open position and a closed position, said venting gas from said hopper including:

vacuuming gas from said hopper when said lid is in said open position; and bleeding off said one of either an inert gas or dry air injected into said hopper and vapors generated by said moisture cure adhesive in said hopper when said lid is in said closed position.

21. The method of reducing premature curing of claim 19, said hot melt adhesive dispensing apparatus further including a lid over said open upper end of said hopper, said lid being selectively positionable between an open position and a closed position, and an exhaust path interconnected at a common junction to a vent path in communication with said vent hole and an ambient source path in communication with an ambient source of air, said common junction having a selectively positionable flow diverter valve located therein that is operatively interconnected to said lid such that said flow diverter valve is placed in a first position when said lid is in said open position, wherein said exhaust path is in communication with said vent path, and said flow diverter valve is placed in a second position when said lid is in said closed position, wherein said exhaust path is in communication with said ambient source path, said flow diverter valve including a valve plate having a bleed hole formed therein, said venting gas from said hopper including:

opening said lid and placing said flow diverter valve in said first position;

vacuuming gas from said hopper through said vent path;

closing said lid and placing said flow diverter valve in said second position; and bleeding off said one of either an inert gas or dry air injected into said hopper and vapors generated by said moisture cure adhesive in said hopper through said bleed hole.

* * * * *